US006767259B2

(12) United States Patent
Kojima et al.

(10) Patent No.: US 6,767,259 B2
(45) Date of Patent: Jul. 27, 2004

(54) TERMINAL FITTING WITH OUTWARDLY PROJECTING ENGAGEMENT PORTION FOR ENGAGING A RESIN LOCK AND A METHOD OF FORMING THE TERMINAL FITTING

(75) Inventors: Eiji Kojima, Yokkaichi (JP); Masahide Hio, Yokkaichi (JP); Hirotaka Makino, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/294,784

(22) Filed: Nov. 14, 2002

(65) Prior Publication Data

US 2003/0096538 A1 May 22, 2003

(30) Foreign Application Priority Data

Nov. 22, 2001 (JP) ..... 2001-357038
Nov. 26, 2001 (JP) ..... 2001-358764

(51) Int. Cl.[7] ..... H01R 13/514; H01R 13/40
(52) U.S. Cl. ..... 439/752; 439/595
(58) Field of Search ..... 439/752, 843, 439/595

(56) References Cited

U.S. PATENT DOCUMENTS 6,227,915 B1 5/2001 Sakatani et al.
6,280,234 B1 8/2001 Yamamoto et al.
6,354,867 B1 * 3/2002 Tachi et al. ..... 439/488
2003/0049965 A1 * 3/2003 Fujita et al. ..... 439/595
2003/0049975 A1 * 3/2003 Tsuji et al. ..... 439/843

FOREIGN PATENT DOCUMENTS

FR 2 769 413 4/1999

* cited by examiner

*Primary Examiner*—Chandrika Prasad
(74) *Attorney, Agent, or Firm*—Anthony J. Casella; Gerald E. Hespos

(57) ABSTRACT

A terminal fitting (1) has connecting portion (5) with an engaging portion (14) to be engaged with a resin lock (13) of a connector (3). The engaging portion (14) projects with a step from an upper wall (12) to ensure a large engaging area with the resin lock (13). An outer edge (14A) of the engaging portion (14) is closer to the resin lock (13) than an inner edge (14B) thereof. Thus, when the terminal fitting (1) is pulled back in withdrawing direction, a force acts to move the leading end of the resin lock (13) from the outer edge (14A) of the engaging portion (14) toward the inner edge (14B). Therefore, the terminal fitting (1) is difficult to disengage from the resin lock (13), and a large engaging force is secured.

10 Claims, 5 Drawing Sheets

TERMINAL FITTING WITH OUTWARDLY PROJECTING ENGAGEMENT PORTION FOR ENGAGING A RESIN LOCK AND A METHOD OF FORMING THE TERMINAL FITTING

BACKGROUND OF THE INVENTION

1. Field of the Invention

The present invention relates to a terminal fitting and to a method for forming it.

2. Description of the Related Art

U.S. Pat. No. 6,280,234 and FIG. 10 herein show a connector 102 that has terminal fittings 101. Each terminal fitting 101 is connected with an end of a wire 100 and is mounted into a corresponding terminal accommodating chamber 103 of the connector 102. Engaging portions 104 are provided near the front ends of the terminal fittings 101 and engage resin locks 105 in the connector 102 to lock the terminal fittings 101.

In recent years, connectors to be mounted in automotive vehicles have been made smaller to cope with an increasing number of circuits. Miniaturized connectors require miniaturized terminal fittings. Terminal fittings have been made smaller by forming the terminal fitting from a thinner plate and by decreasing an area of engagement with the resin lock. As a result, holding forces between the resin locks and a conventionally constructed terminal fitting is not sufficiently large. Thus, a tensile force on wire may cause the terminal fitting to come out of the connector, and may damage the resin lock.

The invention was developed in view of the above problem and an object thereof is to provide a terminal fitting with an engaging portion that can be held by a resin lock with sufficient force even if the terminal fitting is small.

SUMMARY OF THE INVENTION

The invention relates to a terminal fitting formed by stamping, cutting, bending, folding and/or embossing an electrically conductive plate. The terminal fitting has at least one engaging portion to be engaged with a resin lock in a connector into which the terminal fitting is insertable. The engaging portion projects out, preferably with a step, from a portion near the engaging portion by causing a part of the plate to project outward of the terminal fitting. An outer edge of the engaging portion is closer to the resin lock than an inner edge thereof. In other words, the engaging portion is slanted so that the outer edge projects more in a withdrawing direction of the terminal fitting out of the connector housing than the inner edge of the engaging portion. Accordingly, the outer edge comes closer to the resin lock than the inner edge.

The terminal fitting may be a male or female terminal fitting. Additionally, the engaging portion may be at any position on the terminal fitting, and more than one engaging portion may be provided. However, miniaturization may require fewer engaging portions.

The engaging portion projects out of the terminal fitting. Thus, an engaging area with the resin lock can be enlarged as much as a projecting distance of the engaging portion. Therefore, a sufficient engaging force with the resin lock can be ensured even if the terminal fitting is made smaller.

The outer edge of the engaging portion is closer to the resin lock than the inner edge thereof. Thus, the resin lock is not easily disengaged and a larger engaging force can be secured, even if a force acts on the terminal fitting in withdrawing direction.

The engaging portion preferably is at an edge of a window. The window may be a cut-out or stamped-out portion of the plate. The engaging portion is formed from an engaging portion forming end that extends triangularly toward the window from portions of the edge at the opposite sides, and the engaging portion preferably is formed to project triangularly by embossing with the triangularly extending portion substantially as a center.

The engaging portion forming end at the edge of the window projects out when the engaging portion is formed. Hence, the outer edge of the engaging portion is not retracted away from the lock. Further, since the projecting engaging portion is triangular, the engaging portion is not caught while the terminal fitting is inserted into a connector housing.

The window preferably extends on a border between two walls bent at an angle to each other.

A wall preferably is formed on the plate inside the engaging portion, and a groove is provided in a portion of the wall near the engaging portion. Most preferably, the resin lock is at least partly insertable into the groove.

Accordingly, the resin lock of the connector can be fit into the groove in the wall located more inward than the engaging portion. Therefore, a larger engaging area of the engaging portion with the resin lock can be secured.

The invention also relates to a method for forming a terminal fitting. The method comprises providing an electrically conductive plate and stamping, cutting, bending, folding and/or embossing the electrically conductive plate to form the terminal fitting. The formation is carried out by providing the terminal fitting with at least one engaging portion for engaged a resin lock of a connector into which the terminal fitting is insertable. The engaging portion is formed to project out from a portion near the engaging portion by causing a part of the plate to project out of the terminal fitting, and an outer edge of the engaging portion is closer to the resin lock than an inner edge thereof.

The engaging portion may project outward with a step-like shape.

Preferably, a window is provided in the plate and the engaging portion is provided at an edge of the window.

An engaging portion forming end may be formed into the engaging portion and is formed to extend triangularly toward the window from portions of the edge preferably at the opposite sides.

Most preferably, the engaging portion is formed to project triangularly by embossing with the triangularly extending portion substantially as a center.

These and other objects, features and advantages of the present invention will become more apparent upon reading of the following detailed description of preferred embodiments and accompanying drawings.

DETAILED DESCRIPTION OF THE PREFERRED EMBODIMENTS

Hereinafter, one preferred embodiment of the present invention is described in detail with reference to the accompanying drawings. The technical scope of the invention is not limited to the following embodiment, and various changes can be made without departing from the scope and spirit of the present invention as defined in the claims. The technical scope of the present invention is extended to the scope of equivalents.

Figure 1:
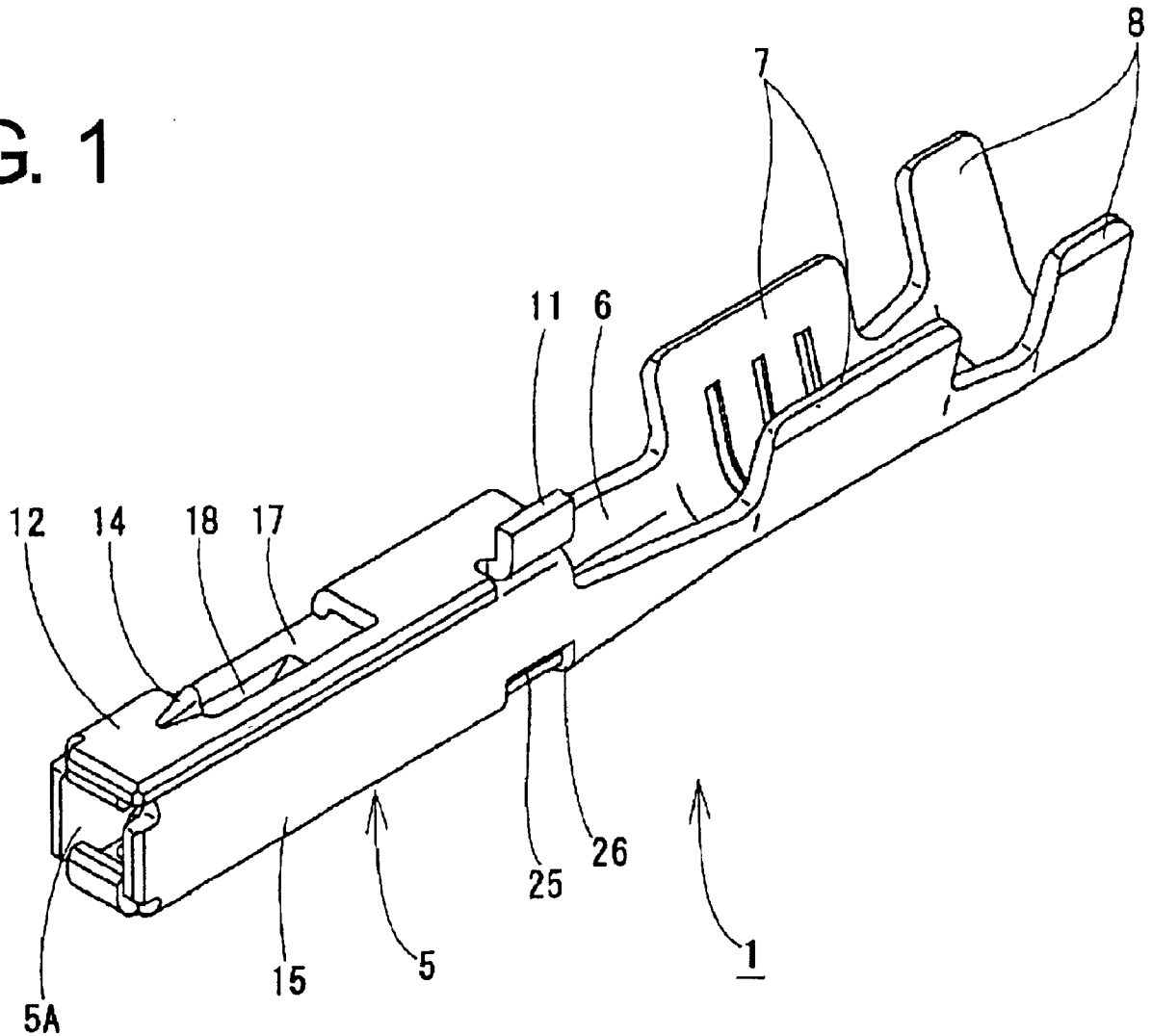
FIG. 1 is a perspective view of a terminal fitting according to one embodiment of the present invention.
Figure 8:
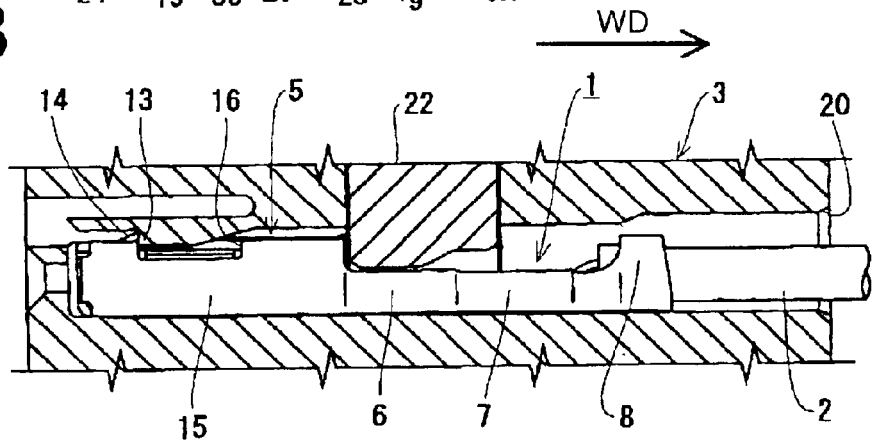
FIG. 8. is a side sectional view showing a state where the terminal fitting connected with a wire is mounted in a connector.
Figure 9:
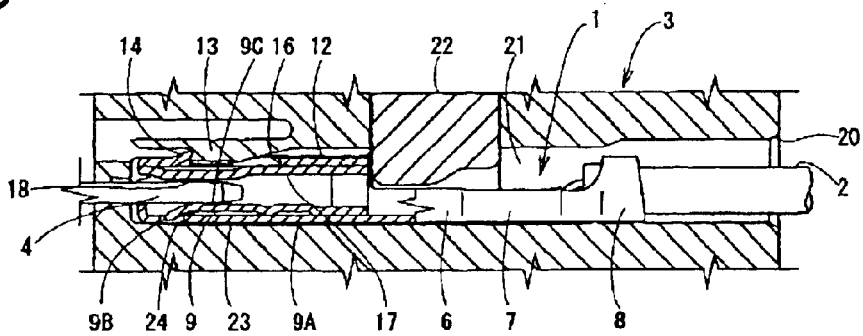
FIG. 9 is a side sectional view of the connector when a tab of a male terminal fitting is inserted (a connecting portion of the male terminal fitting shown in section).
Figure 10:
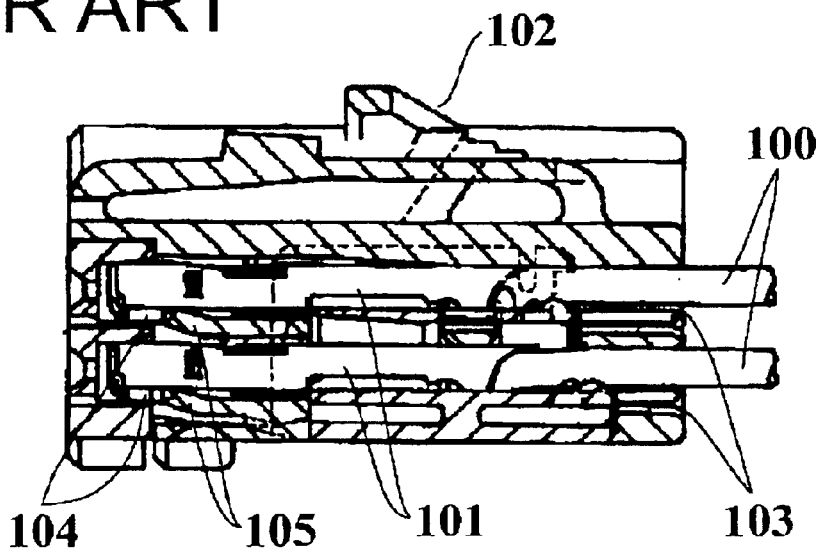
FIG. 10 PRIOR ART
FIG. 10 is a side view showing a state where terminal fittings of prior art connected with wires are mounted in a connector.

A terminal fitting according to the invention is identified by the numeral 1 in FIG. 1. The terminal fitting 1 is a female terminal fitting and is mountable into a connector 3 (see FIG. 8 or 9) while being connected with an end of a wire 2. The terminal fitting 1 is produced in consideration of miniaturization, and preferably is only about 0.6 mm to about 2 mm wide. In the following description, the end of the terminal fitting 1 to be connected with the wire 2 is referred to as the rear and an opposite end to be connected with a male tab 4 of a mating male terminal fitting is referred to as the front.

The terminal fitting 1 has a rectangular tubular connecting portion 5 at the front end. A coupling portion 6 of substantially C-shaped cross section is provided behind the connecting portion 5, and barrels 7, 8 are provided behind the coupling portion 6. The barrels include wire barrels 7 nearer the coupling portion 6 for crimped, bent or folded connection with the core of the wire 2 and insulation barrels 8 behind the wire barrels 7 for crimped, bent or folded connection with an insulation coating of the wire 2.

Figure 6:
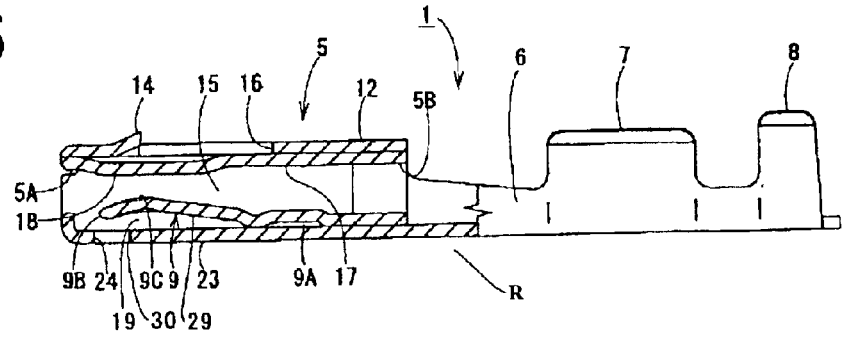
FIG. 6 is a sectional view along 6—6 of FIG. 5.
Figure 7:
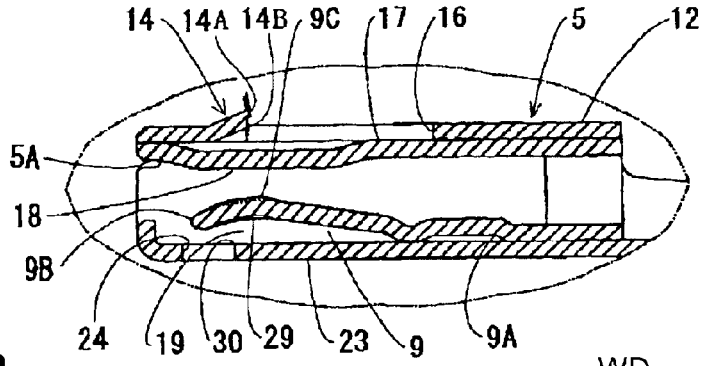
FIG. 7 is a partial enlarged view of an area enclosed by an ellipse R in FIG. 6.

The connecting portion 5 is in the form of a substantially rectangular tube with opposed sidewalls 15, an upper contact wall 17 and a lower wall 23. A male tab insertion opening 5A is provided at the front end of the connecting portion 5, as shown in FIG. 6 or 7, and is configured to receive a male tab 4. A rear opening 5B is formed at the rear end of the connecting portion 5. An outer wall 12 is disposed outside the upper contact wall 17. The upper contact wall portion 17 is embossed inwardly to form an outwardly open groove 18. The bottom wall 23 has a resilient contact piece 9 with a base 9A at the rear end and a free end 9B extending obliquely up and to the front. The resilient contact piece 9 can be brought resiliently into contact with the male tab 4.

The free end 9B of the resilient contact 9 curves slightly down, and an upwardly convex contact 9C is provided slightly behind the free end 9B for contacting the male tab 4. An area between the contact piece 9 and the bottom wall 23 serves as a resilient deformation permitting space 19 for permitting deformation of the resilient contact piece 9. A deformation permitting hole 24 is formed in the bottom wall 23 below the free end 9B of the resilient contact piece 9. Thus, the free end 9B is insertable into the deformation permitting hole 24 as the resilient contact piece 9 is deformed down to enlarge a degree of the deformation of the resilient contact piece 9.

The rear edge of the deformation permitting hole 24 serves as an excessive deformation preventing portion 30 that can contact a rear surface 29 of the resilient contact piece 9 to prevent excessive deformation of the resilient contact piece 9. Further, the free end 9B is inside the bottom wall 23 or substantially at the same position as the outer surface of the bottom wall 23 when the rear surface 29 contacts the excessive deformation preventing portion 30. Therefore, the free end 9B does not project out of the connecting portion 5.

Figure 2:
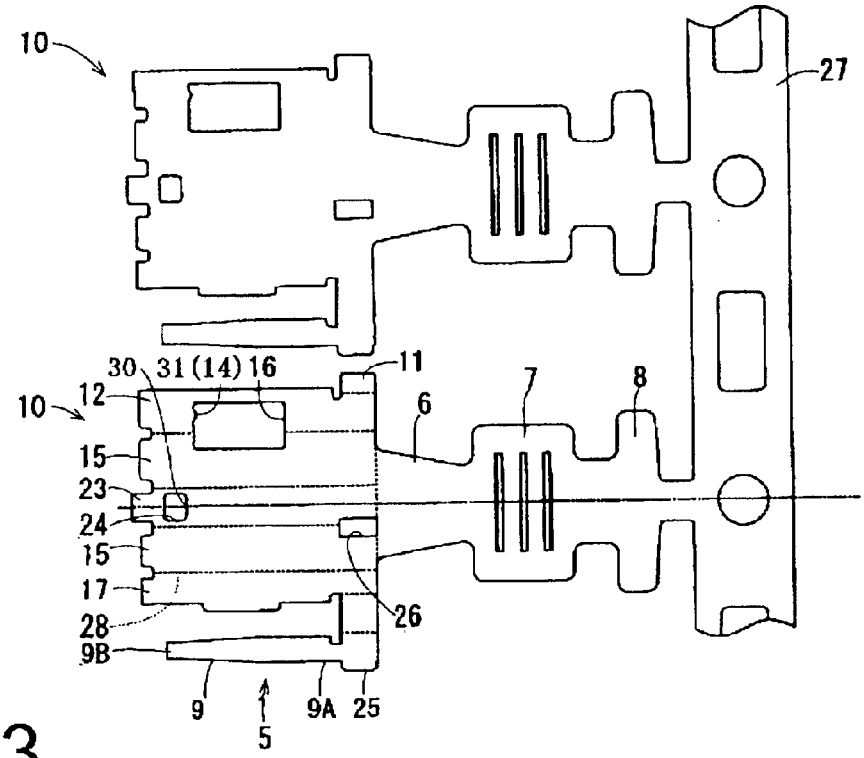
FIG. 2. is a plan view of a plate to be formed into the terminal fitting.
Figure 3:
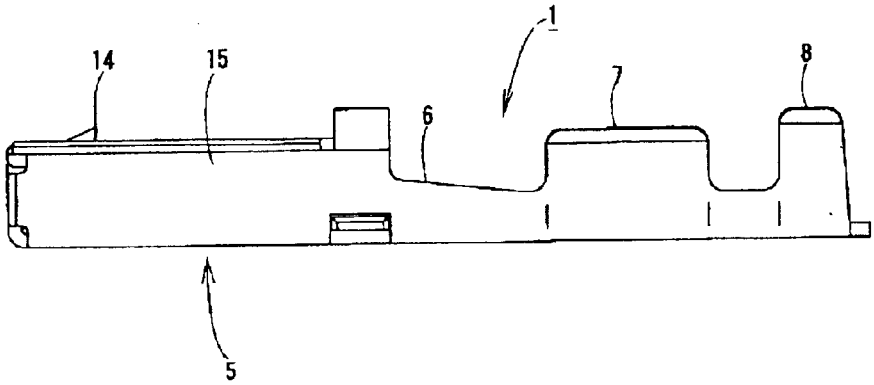
FIG. 3 is a side view of the terminal fitting.
Figure 4:
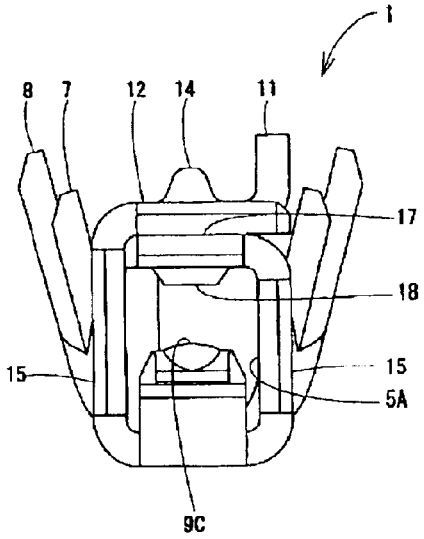
FIG. 4. is a front view.

A plate 10 to be formed into the terminal fitting 1 is illustrated FIG. 2, and reference numerals in FIG. 2 identify the portions of the formed terminal fitting 1 excluding an engaging portion forming end 31.

The plates 10 are formed at spaced intervals along a strip 27 by stamping, cutting, bending, folding and/or embossing an electrically conductive plate by a press. Each plate 10 is bent successively along specified imaginary A terminal fitting according to the invention is identified by the numeral 1 in FIG. 1. The terminal fitting 1 is a female terminal fitting and is mountable into a connector 3 (see FIG. 8 or 9) while being connected with an end of a wire 2. The terminal fitting 1 is produced in consideration of miniaturization, and preferably is only about 0.6 mm to about 2 mm wide. In the following description, the end of the terminal fitting 1 to be connected with the wire 2 is referred to as the rear and an opposite end to be connected with a male tab 4 of a mating male terminal fitting is referred to as the front.

The terminal fitting 1 has a rectangular tubular connecting portion 5 at the front end. A coupling portion 6 of substantially C-shaped cross section is provided behind the connecting portion 5, and barrels 7, 8 are provided behind the coupling portion 6.The barrels include wire barrels 7 nearer the coupling portion 6 for crimped, bent or folded connection with the core of the wire 2 and insulation barrels 8 behind the wire barrels 7 for crimped, bent or folded connection with an insulation coating of the wire 2.

The connecting portion 5 is in the form of a substantially rectangular tube with opposed sidewalls 15, an upper contact wall 17 and a lower wall 23. A male tab insertion opening 5A is provided at the front end of the connecting portion 5, as shown in FIG. 6 or 7, and is configured to receive a male tab 4. A rear opening 5B is formed at the rear end of the connecting portion 5. An outer wall 12 is disposed outside the upper contact wall 17. The upper contact wall portion 17 is embossed inwardly to form an outwardly open groove 18. The bottom wall 23 has a resilient contact piece 9 with a base at the rear end and a free end 9B extending obliquely up and to the front. The resilient contact piece 9 can be brought resiliently into contact with the male tab 4.

The free end 9B of the resilient contact 9 curves slightly down, and an upwardly convex contact 9C is provided slightly behind the free end 9B for contacting the male tab 4. An area between the contact piece 9 and the bottom wall 23 serves as a resilient contact piece 9. A deformation permitting hole 24 is formed in the bottom wall 23 below the free end 9B of the resilient contract piece 9. Thus, the free end 9B is insertable into the deformation permitting hole 24 as the resilient contact piece 9 is deformed down to enlarge a degree of the deformation of the resilient contact piece 9.

The rear edge of the deformation permitting hole 24 serves as an excessive deformation preventing portion 30 that can contact a rear surface 29 of the resilient contact piece 9 to prevent excessive deformation of the resilient contact piece 9. Further, the free end 9B is inside the bottom wall 23 or substantially at the same position as the outer surface of the bottom wall 23 when the rear surface 29 contacts the excessive deformation preventing portion 30. Therefore, the free end 9B does not project out of the connecting portion 5.

A plate 10 to be formed into the terminal fitting 1 is illustrated FIG. 2, and reference numerals in FIG. 2 identify the portions of the formed terminal fitting 1 excluding an engaging portion forming end 31.

The plates 10 are formed at spaced intervals along a strip 27 by stamping, cutting, bending, folding and/or embossing an electrically conductive plate by a press. Each plate 10 is bent successively along specified imaginary bending lines 28 shown by dotted line in the lower plate 10 in FIG. 2. However, the actual plate 10 looks like the plate 10 shown at the upper side of FIG. 2 and has no bending line 28. After formation, each terminal fitting 1 is separated from the strip 27, e.g. when being connected to the wire 2. The terminal fitting 1 may be supplied on a reel to the manufacturing or connecting place.

The resilient contact piece 9 of the plate 10 is initially straight, and an engaging edge 25 projects laterally from the base 9A of the resilient contact piece 9. The base 9A of the resilient contact piece 9 is positioned by being fit into a locking hole 26 during the bending of the terminal fitting 1.

Figure 5:
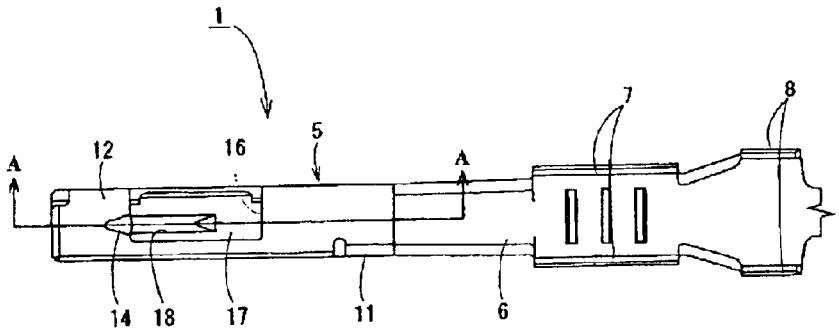
FIG. 5. is a plan view of the terminal fitting.

An engaging portion 14 is formed on the upper surface of the connecting portion 5 and is engageable with a resin lock 13 in the connector 3. The engaging portion forming end 31 to become the engaging portion 14 projects triangularly at the front edge of a window 16 in the outer wall 12. The window 16 is formed by cutting away an area that extends from the outer wall 12 to the sidewall 15 of the connecting portion 5, as shown in FIG. 2. Alternatively, the window 16 may be provided by recessing the plate 10 inwardly. Accordingly, the engaging portion 14 is substantially triangular in plan view (FIG. 5). Moreover, the engaging portion 14 has a substantially triangular or pointed cross-section along a transverse direction. The engaging portion forming end 31 is formed into the triangularly projecting engaging portion 14 by embossing to project out of the connecting portion 5. Alternatively, cutting and bending may be applied to form the engaging portion forming end 31. Further, an outer edge 14A of the engaging portion 14 is closer to the resin lock 13 than an inner edge 14B, as shown in FIG. 7. In other words, the rear end of the engaging portion 14 slants forward and inward toward the mating side from the outer edge 14A toward the inner edge 14B to intensify the engagement of the engaging portion 14 with the resin lock 13 when a force acts on the terminal fitting 1 in withdrawing direction WD. Further, attention is paid not to make the rear end of the engaging portion 14 at an obtuse angle to the upper wall 12 due to the insufficient elongation of the plate member 10.

The outwardly open groove 18 is formed in the upper contact wall 17 inwardly of and near the engaging portion 14, as shown in FIG. 7. The bottom convex surface of the groove 18 serves as a contact portion for contacting the male tab 4 of the mating male terminal fitting. Further, a stabilizer 11 projects at one side edge of the rear end of the upper surface of the connecting portion 5. The stabilizer 11 fits into a groove (not shown) in the upper wall of the terminal accommodating chamber 21 to restrict movements of the terminal fitting 1 along vertical or lateral directions and hence stabilizes the position of the mounted terminal fitting 1.

The wire 2 is prepared by stripping the insulation coating off the end. The wire 2 then is placed into the terminal fitting 1 from above, and the wire 2 and the terminal fitting 1 are connected by crimping, bending or folding the barrels 7, 8. The leading end of the terminal fitting 1 then is inserted through a terminal insertion opening 20 of the connector 3 and into the terminal accommodating chamber 21. Thus, the front end of the resin lock 13 is pushed by the engaging portion 14 and is deformed outwardly toward the upper side of FIGS. 8 and 9. The resin lock 13 is restored resiliently when the terminal fitting 1 is pushed to a proper mount position and contacts the engaging portion 14 to lock the terminal fitting 1 in the terminal accommodating chamber 21. The engaging portion 14 projects with a step from the upper wall 12, and hence a large area of engagement with the resin lock 13 can be secured.

The outer edge 14A of the engaging portion 14 is closer to the resin lock 13 than the inner edge 14B. Thus, a force acts to move the leading end of the resin lock 13 from the outer edge 14A of the engaging portion 14 toward the inner edge 14B when the terminal fitting 1 is pulled back in withdrawing direction WD. Accordingly, the terminal fitting 1 is difficult to disengage from the resin lock 13, and a larger engaging force can be secured easily.

A retainer 22 then is pushed to a full locking position and fits into the coupling portion 6 of the terminal fitting 1 to lock the terminal fitting 1 doubly.

As described above, the engaging portion 14 projects outward of the terminal fitting 1. Further, the outer edge 14A of the projecting engaging portion 14 is not retracted away from the locking portion 13. Thus, the engaging area with the resin lock 13 can be increased by the projecting distance of the engaging portion 14, and a sufficient engaging force with the resin lock 13 can be secured even if the terminal fitting 1 is made smaller. Additionally, the projecting engaging portion 14 is substantially triangularly pointed in plan view and in cross-section. Therefore, the engaging portion 14 is not caught while the terminal fitting 1 is inserted into the connector housing. In particular, the engaging portion 14 is slanted along the longitudinal direction of the terminal fitting 1 and therefore will not get caught with the resin lock 13. Furthermore, the engaging portion 14 can be constructed simply.

The outer edge 14A of the engaging portion 14 is closer to the resin lock 13 than the inner edge 14B. Thus, the terminal fitting 1 is difficult to disengage from the resin lock 13, and a larger engaging force can be secured.

The resin lock 13 is at least partly fit into the groove 18 in the contact wall 17 while being engaged with the engaging portion 14. Thus, a large engaging area of the engaging portion 14 with the resin lock 13 is secured.

What is claimed is:

1. A terminal fitting formed from an electrically conductive plate and having opposite front and rear ends, the rear end of the terminal fitting being configured for connection with a wire, the terminal fitting being provided with at least one engaging portion between the front and rear ends for engaging a resin lock in a connector into which the terminal fitting is insertable, the engaging portion projecting outwardly on the, terminal fitting, and having a rear edge, an outer portion of the rear edge of the engaging portion being closer to the rear end of the terminal fitting than an inner portion of the rear edge.

2. The terminal fitting of claim 1, wherein the engaging portion projects outwardly with a step-like shape.

3. The terminal fitting of claim 1, further comprising a window in a wall of the terminal fitting substantially adjacent the engaging portion.

4. The terminal fitting of claim 3, wherein the engaging portion projects triangularly toward the window.

5. The terminal fitting of claim 3, wherein the window extends on a border between two walls bent substantially normal to each other.

6. The terminal fitting of claim 3, wherein a wall is formed inwardly of the engaging portion, and an inwardly directed groove is provided in a portion of the wall substantially aligned with the engaging portion.

7. The terminal fitting of claim 6, wherein the resin lock is at least partly insertable into the groove.

8. A terminal fitting with opposite front and rear ends and a substantially tubular connecting portion between the ends, at least a section of the tubular connecting portion having inner and outer walls, a window formed in a section of the outer wall of the tubular connecting portion, said window being defined by a plurality of edges including a front edge and a rear edge, an engaging portion projecting outwardly on the tubular connecting portion at said front edges of the window, an inwardly directed groove formed in the inner wall at a location substantially aligned with the engaging portion and with at least a portion of the window for providing an increased depth of engagement of the engaging portion with a resin lock of a connector housing.

9. The terminal fitting of claim 8, wherein the edge at the engaging portion has outer and inner edge sections, the outer edge section projecting further over the window than the inner edge thereof.

10. The terminal fitting of claim 9, wherein the terminal fitting has opposite front and rear ends, the connecting portion being at the front end, a wire connection barrel being defined at the rear end of the terminal fitting, the edge of the window defining the engaging portion facing toward the rear end of the terminal fitting.

* * * * *